US007841702B2

(12) United States Patent
Guan et al.

(10) Patent No.: US 7,841,702 B2
(45) Date of Patent: Nov. 30, 2010

(54) HEATER STACK AND METHOD FOR MAKING HEATER STACK WITH HEATER ELEMENT DECOUPLED FROM SUBSTRATE

(75) Inventors: Yimin Guan, Lexington, KY (US); Burton Lee Joyner, II, Lexington, KY (US); Zachary Justin Reitmeier, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 206 days.

(21) Appl. No.: 12/265,092

(22) Filed: Nov. 5, 2008

(65) Prior Publication Data

US 2010/0110145 A1 May 6, 2010

(51) Int. Cl.
*B41J 2/05* (2006.01)

(52) U.S. Cl. ..... 347/56

(58) Field of Classification Search ..... 347/56, 347/57–59, 54, 50, 61–65, 44, 40, 20
See application file for complete search history.

(56) References Cited

U.S. PATENT DOCUMENTS 6,787,051 B2 * 9/2004 Silverbrook ..... 347/54
7,195,343 B2 * 3/2007 Anderson et al. ..... 347/63

* cited by examiner

*Primary Examiner*—K. Feggins

(57) ABSTRACT

A heater stack includes first strata configured to support and form a fluid heater element responsive to repetitive electrical activation and deactivation to produce cycles of fluid ejection and second strata overlying the first strata to protect the heater element. A decomposed sacrificial layer of a preselected polymer between the substrate and a heater substrata containing the heater element provides a decoupled relationship between them which, during a heat-up period of each cycle, results in the heater element buckling out of physical contact with substrate enabling the heater element to transfer heat energy for producing fluid ejection into the fluid without transferring any into the substrate whereas the decoupled relationship, during the next following cool-down period of each cycle, results in the heater element de-buckling back into physical contact with the substrate enabling the heater element transfer residual heat energy to the substrate.

19 Claims, 5 Drawing Sheets

HEATER STACK AND METHOD FOR MAKING HEATER STACK WITH HEATER ELEMENT DECOUPLED FROM SUBSTRATE

BACKGROUND

1. Field of the Invention

The present invention relates generally to micro-fluid ejection devices and, more particularly, to a heater stack of a micro-fluid ejection device and a method for making the heater stack with its fluid heater element decoupled from its substrate.

2. Description of the Related Art

Micro-fluid ejection devices have had many uses for a number of years. A common use is in a thermal inkjet printhead in the form of a heater chip. In addition to the heater chip, the inkjet printhead basically includes a source of supply of ink, a nozzle plate attached to or integrated with the heater chip, and an input/output connector, such as a tape automated bond (TAB) circuit, for electrically connecting the heater chip to a printer during use. The heater chip is made up of a plurality of resistive heater elements, each being part of a heater stack. The term "heater stack" generally refers to the structure associated with the thickness of the heater chip that includes first, or heater forming, strata made up of resistive and conductive materials in the form of layers or films on a substrate of silicon or the like and second, or protective, strata made up of passivation and cavitation materials in the form of layers or films on the first strata, all fabricated by well-known processes of deposition, patterning and etching upon the substrate of silicon. The heater stack also has one or more fluid vias or slots that are cut or etched through the thickness of the silicon substrate and the first and second strata, using these well-known processes, serve to fluidly connect the supply of ink to the heater stacks. A heater stack having this general construction is disclosed as prior art in U.S. Pat. No. 7,195,343, which patent is assigned to the same assignee as the present invention. The disclosure of this patent is hereby incorporated by reference herein.

Despite their seeming simplicity, construction of heater stacks requires consideration of many interrelated factors for proper functioning. The current trend for inkjet printing technology (and micro-fluid ejection devices generally) is toward lower jetting energy, greater ejection frequency, and in the case of printing higher print speeds. A minimum quantity of thermal energy must be present on an external surface of the heater stack above a resistive heater element therein, in order to vaporize the ink inside an ink chamber between the heater stack external surface and a nozzle in the nozzle plate so that the ink will vaporize and escape or jet through the nozzle in a well-known manner. The overall heating energy or "jetting energy" produced by the heater stack must pass through the plurality of layers of the first and second strata that form the heater stack before the requisite energy for fluid ejection reaches the external surface of the heater stack. The greater the thickness of the layers of the first strata of the heater stack, the more jetting energy that will be required before the requisite energy for ink drop formation and ejection can be reached on the heater stack external surface. However, a minimum presence of protective layers of the second strata of the heater stack is necessary to protect the resistive heater element from chemical corrosion, from fluid breaks, and from mechanical stress from the effects of cavitation.

During inkjet heater chip operation, some of the heating energy is wasted due to heating up the "heater overcoat", or the second strata, and also heating up the substrate. Since heating or jetting energy required is proportional to the volume of material of the heater stack that is heated during an ejection sequence, reducing the heater overcoat thickness, as proposed in U.S. Pat. No. 7,195,343 is one approach to reducing the jetting energy required. However, as the overcoat thickness is reduced, corrosion of the ejectors or heater elements becomes more of a factor with regard to ejection performance and quality. So this patent proposes the additional steps of applying a sacrificial layer of an oxidizable metal on the resistive heater layer and then oxidizing the sacrificial layer to convert it to exhibit a protective function rather than a conductive function and thereby obviate the potential corrosive impacts of reducing overcoat thickness.

However, with the overcoat thickness decreasing, heat loss to the substrate then becomes the dominant factor. Thus, there is a need for an innovation that will reduce the heat loss to the substrate.

SUMMARY OF THE INVENTION

The present invention meets this need by providing an innovation which involves only a small degree of change or modification to the heater stack in its first strata structure and to the currently-employed fabricating processes and which basically is compatible therewith and minimizes any additional costs. Underlying certain embodiments of the present invention is the insight by the inventors herein that performance of the heater stack could be enhanced in terms of attainment of improved thermal efficiency by substantially decoupling the attachment, but not the physical contact of, the fluid heater element of the heater stack from the underlying substrate of the heater stack. The benefits of this heater stack structure is that during the heat-up period of an ink jetting cycle at east the fluid heater element will buckle upward away from and out of contact with the substrate due to thermal expansion which will enable the fluid heater element to transfer most of its jetting energy into the ink above it with virtually none transferring into the substrate below it. Then, during the next following cool-down period of the ink jetting cycle, the fluid heater element will thermally contract or de-buckle downward toward and back into physical contact with (substantially touch) the substrate so that the fluid heater element will now transfer quickly any residual heat it has into the substrate in preparation for the next jetting cycle. This decouple-for-heating heater stack structure will substantially enable the attainment of an adequate jetting frequency.

Accordingly, in an aspect of the present invention, a heater stack for a micro-fluid ejection device includes a first strata configured to support and form a fluid heater clement responsive to repetitive electrical activation and deactivation to produce repetitive cycles of fluid ejection from the device, and second strata overlying the first strata to provide protection of the fluid heater element from adverse effects of the repetitive cycles of fluid ejection, each cycle involving alternating periods of heat-up and cool-down of the fluid heater element. The first strata includes a substrate, heater substrata overlying the substrate, and a sacrificial layer of a predetermined material, particularly a preselected polymer, deposed between the substrate and heater substrata and processed so as to provide a decoupled relationship at least between the fluid heater element and the substrate. During the heat-up period of a respective cycle of fluid ejection, the decoupling results in at least the fluid heater element buckling away from and out of physical contact with the substrate due to thermal expansion of the fluid heater element in response to the electrical activation thereof enabling the fluid heater element to transfer heat energy for producing fluid ejection into the fluid substantially without transferring the heat energy into the substrate. During the next following cool-down period of the respective cycle of fluid ejection, the decoupling results in the fluid heater element de-buckling back toward and into physical contact with the substrate due to thermal contraction of the fluid beater element in response to the electrical deactivation thereof enabling the fluid heater element to transfer residual heat energy to the substrate and prepare for the following heat-up period of the next respective one of the cycles of fluid ejection.

In another aspect of the present invention, a method for making a heater stack includes processing one sequence of materials to produce first strata supporting and forming a fluid heater element, wherein processing the one sequence of materials includes depositing a sacrificial layer of a predetermined material, particularly a preselected polymer, on a substrate, depositing and patterning layers of resistive and conductive materials on the sacrificial layer to produce a heater substrata supporting and forming thereon the fluid heater element responsive to repetitive electrical activation and deactivation to produce repetitive cycles of fluid ejection from the device, each cycle involving alternating periods of heat-up and cool-down of the fluid heater element corresponding respectively to the repetitive electrical activation and deactivation of the fluid heater element, and decomposing the sacrificial layer of the predetermined material so as to produce a decoupled relationship between at least the fluid heater element and substrate. During the heat-up period of a respective one of the cycles of fluid ejection, the decoupled relationship results in at least the fluid heater element buckling away from and out of physical contact with the substrate due to thermal expansion of the fluid heater element in response to the electrical activation thereof enabling the fluid heater element to transfer heat energy for producing fluid ejection into the fluid substantially without transferring the heat energy into the substrate. During the next following cool-down period of the respective one of the cycles of fluid ejection, the decoupled relationship results in the fluid heater element de-buckling back toward and into physical contact with the substrate due to thermal contraction of the fluid heater element in response to the electrical deactivation thereof enabling the fluid heater element to transfer residual heat energy to the substrate and prepare for the following heat-up period of the next respective one of the cycles of fluid ejection. The method also includes processing another sequence of materials to produce second strata overlying the heater substrata and the fluid heater element thereof to provide protection of the fluid heater element from adverse effects of the repetitive cycles of fluid ejection.

BRIEF DESCRIPTION OF THE DRAWINGS

Having thus described the invention in general terms, reference will now be made to the accompanying drawings, which are not necessarily drawn to scale, and wherein

Figure 1:
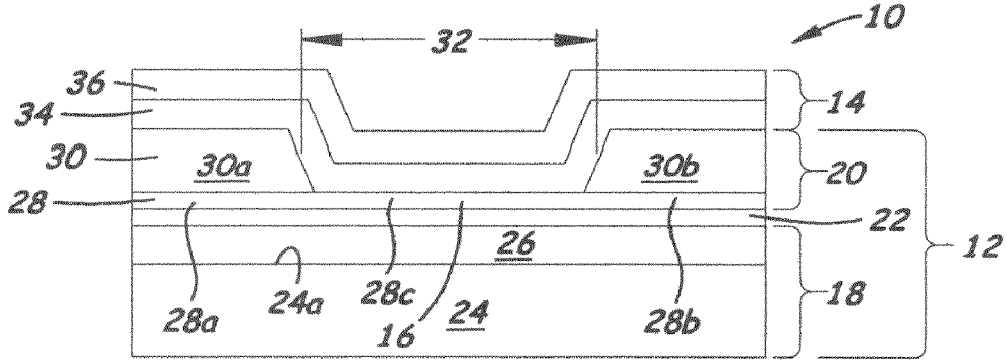

FIG. 1 is a cross-sectional schematic representation, not to scale, of a first exemplary embodiment of a heater stack of a micro-fluid ejection device in accordance with the present invention.

Figure 2:
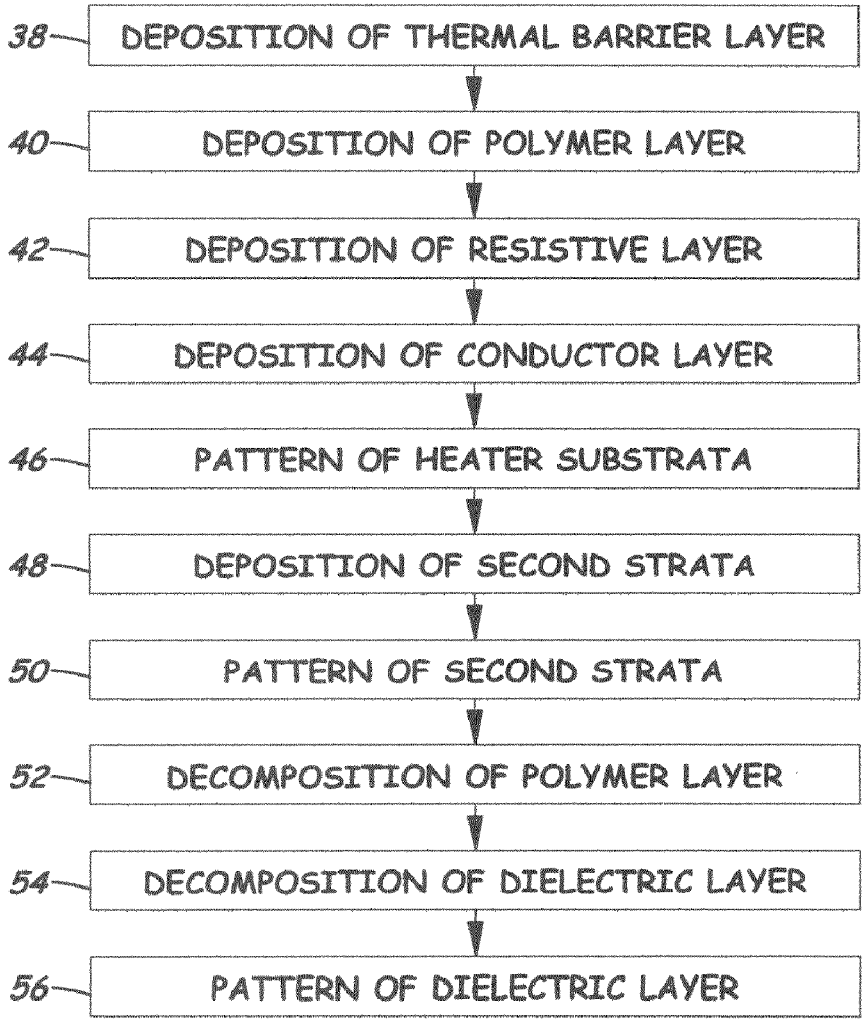

FIG. 2 is a block flow diagram of a sequence of the steps in making the first exemplary embodiment of the heater stack of FIG. 1.

FIGS. 3-11 are cross-sectional schematic representations, not to scale, of a sequence of stages in making the first exemplary embodiment of the heater stack of FIG. 1 in accordance with the flow diagram of FIG. 2.

Figure 12:
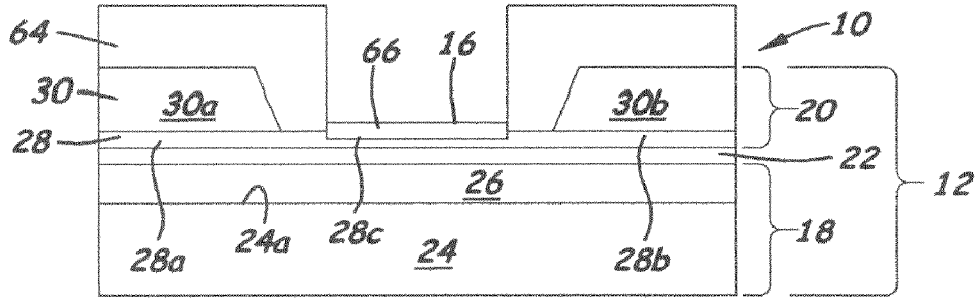

FIG. 12 is a cross-sectional schematic representation, not to scale, of a second exemplary embodiment of a heater stack of a micro-fluid ejection device in accordance with the present invention.

Figure 13:
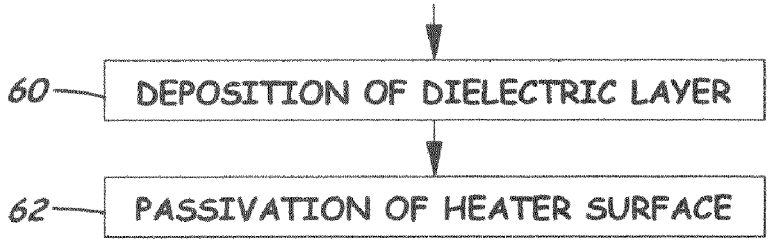

FIG. 13 is a block flow diagram of a sequence of the steps in making the second exemplar embodiment of the heater stack of FIG. 12.

Figure 14:
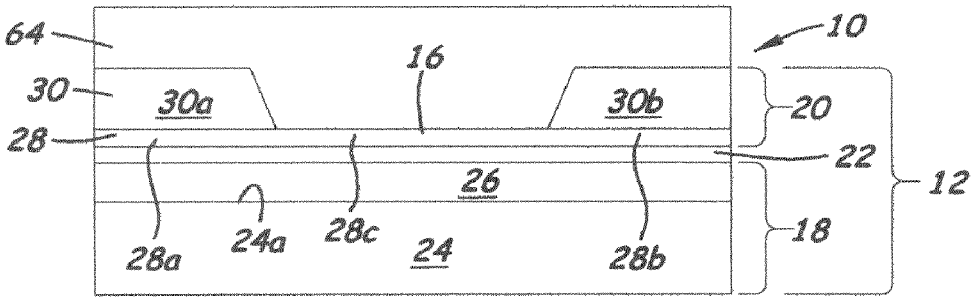
Figure 15:
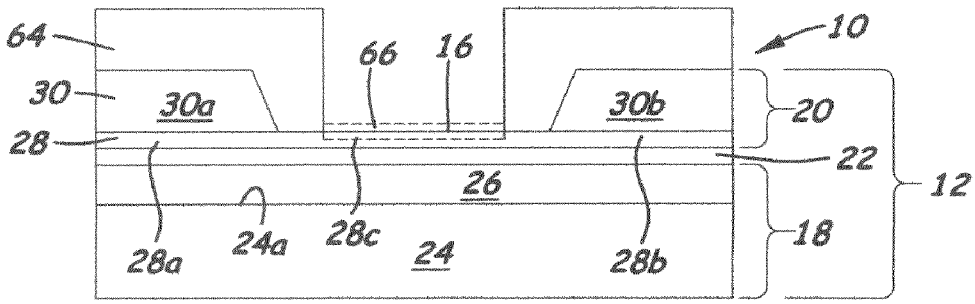

FIGS. 14 and 15 are cross-sectional schematic representations, not to scale, of the stages that are used with those of FIGS. 3-7 and 10 in making the second exemplary embodiment of the heater stack of FIG. 12 in accordance with the flow diagram of FIG. 13.

Figure 16A:
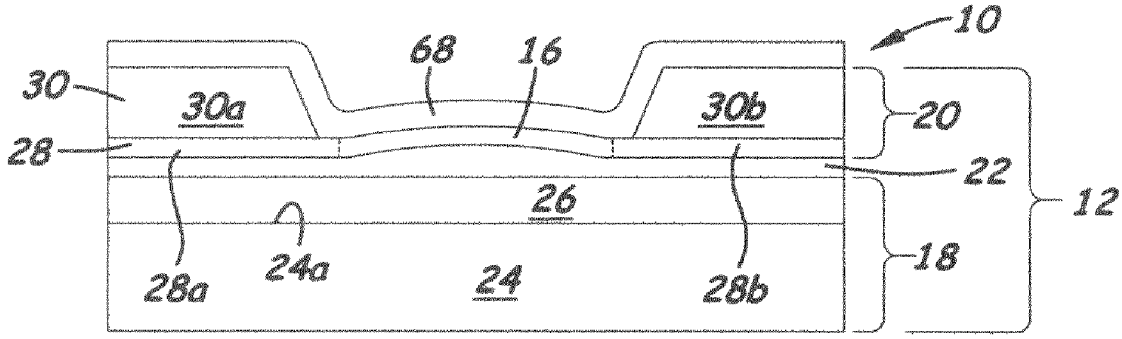
Figure 16B:
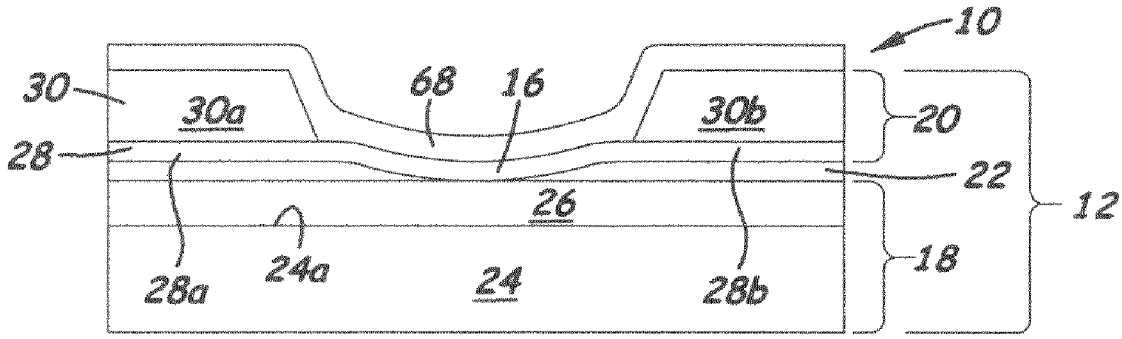

FIGS. 16A and 16B are cross-sectional schematic representations, not to scale, of the heater stack respectively showing its fluid heater element in a buckled condition during the heat-up period of an ink jetting cycle and in a de-buckled or at rest condition during the cool-down period of the ink jetting cycle.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Also, the present invention applies to any micro-fluid ejection device, not just to heater stacks for thermal inkjet printheads. While the embodiments of the present invention will be described in terms of a thermal inkjet printhead, one of ordinary skill will recognize that the invention can be applied to any micro-fluid ejection system.

Referring now to FIG. 1, there is illustrated a first exemplar embodiment of a heater stack, generally designated 10, of a micro-fluid ejection device in accordance with the present invention. The heater stack 10 basically includes first (or heater forming) strata, generally designated 12, and second (or protective) strata, generally designated 14. The first strata 12 are configured to support and form a fluid heater element 16 in the heater stack 10 that is responsive to repetitive electrical activation and deactivation to produce repetitive cycles of fluid ejection from the ejection device. The second strata 14 overlie the first strata 12 and are configured to protect the fluid heater element 16 from well-known adverse effects of the repetitive cycles of fluid ejection. Each repetitive cycle involves alternating periods of heat-up and cool-down of the fluid heater element 16.

More particularly the first strata 12 of the heater stack 10 includes a substrate 18, a heater substrata, generally designated 20, overlying the substrate 18, and a sacrificial layer 22 of a predetermined material, such as a suitable preselected polymer, deposed between the substrate 18 and the heater substrata 20. The substrate 18 includes a base layer 24 of silicon or the like which at its front surface 24*a* has a thermal barrier layer 26 thereon to reduce any heat being thermally conducted to the base layer 24 of the substrate 18 from the heater substrata 20 during the repetitive cycles of fluid ejection. The sacrificial layer 22 overlies the thermal barrier layer 26. The heater substrata 20 includes a resistor or resistive film or layer 28 overlying the sacrificial layer 22 and an electrical conductor film or layer 30 partially overlying the resistive layer 28. The conductor layer 30 has a gap 32 defined therein separating the conductor layer 30 into an anode portion 30*a* and a cathode portion 30*b* which overlie corresponding spaced apart lateral portions 28*a*, 28*b* of the resistive layer 28. The latter are interconnected and separated by a central portion 28*c* of the resistive layer 28 deposed under and co-extensive with the gap 32 of the conductor layer 30. The anode and cathode portions 30*a*, 30*b* of the conductor layer 30, being positive and negative terminals of ground and power leads electrically connected to a tab circuit (not shown), cooperate with the central portion 28*c* of the resistive layer 28 to form the fluid heater element 16 of the heater substrata 20 of the first strata 12. By way of example and not of limitation the various layers of the first strata 12 can be made of the various materials and have the ranges of thicknesses as set forth in above cited U.S. Pat. No. 7,195,343.

The second strata 14 of the heater stack 10 overlie the first strata 12 and more particularly the heater substrata 20 of the first strata 12 to protect the resistive fluid heater element 16 from the well-known adverse effects of fluid forces generated by the repetitive cycles of fluid ejection from the device. The second strata 14 include a passivation (protective) layer 34 and a cavitation (protective) layer 36. The function of the passivation layer 36 is primarily to protect the resistive and conductor layers 28, 30 of the first strata 12 from fluid corrosion. The function of the cavitation layer 36 is to provide protection to the fluid heater element 16 during fluid ejection operation which would cause mechanical damage to the heater stack 10 in the absence of the cavitation layer 36. By way of example and not of limitation, the various layers of the second strata 14 also can be made of the various materials and have the ranges of thicknesses as set forth in above cited U.S. Pat. No. 7,195,343.

Figure 3:
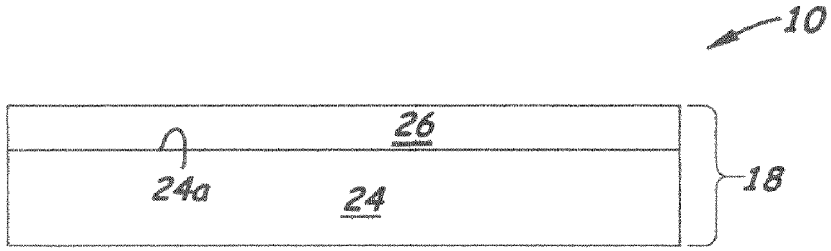
Figure 4:
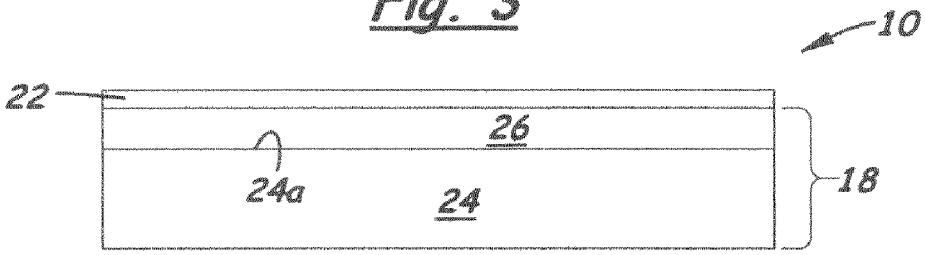
Figure 5:
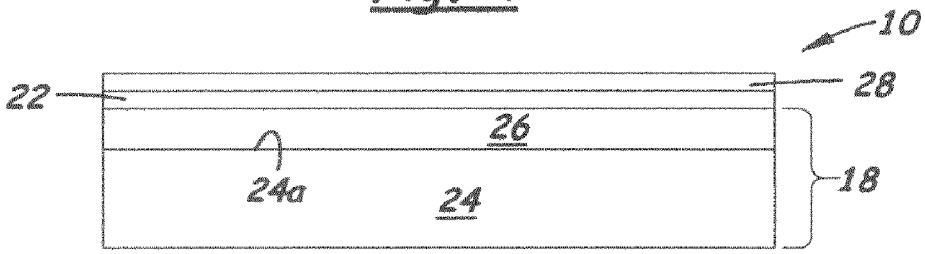
Figure 6:
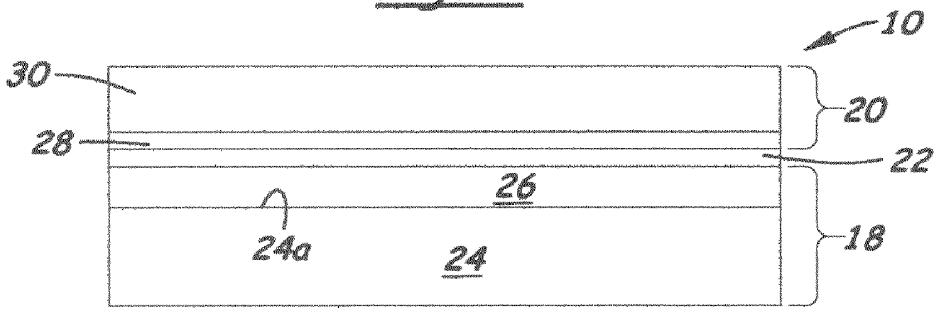
Figure 7:
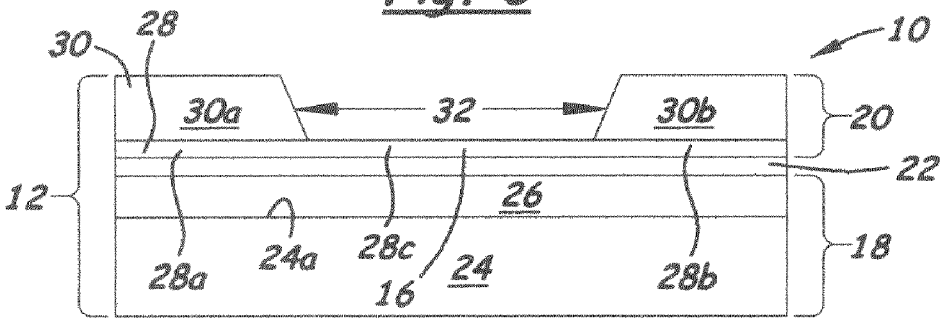

Turning now to FIGS. 2-10, there is illustrated a block flow diagram, in FIG. 2, of the steps carried out in making the first exemplary embodiment of the heater stack 10 of FIG. 1 and also schematic representations, in FIGS. 3-10, of a sequence of stages in building the layers making up the heater stack 10 in accordance with the steps represented in the flow diagram of FIG. 2. Turning initially to FIG. 3-7, there is illustrated the sequence of stages in building the layers making up the first strata 12 of the heater stack 10. The substrate 18 in the first strata 12 provides a base layer 24 of silicon upon which all the other layers of the first and second strata 12, 14 are deposited and patterned by using selected techniques of conventional thin film integrated circuit processing techniques including layer growth, chemical vapor deposition, photo resist deposition, masking developing, etching and the like. As seen in FIG. 3 and as per block 38 in FIG. 2, initially the thermal barrier layer 26 is deposited on the silicon substrate base layer 24 to provide an insulation or overglaze layer, such as borophosphosilicate glass, BPSG. With the thermal barrier layer 26 so formed on the front surface 24*a* of the substrate 18, next as seen in FIG. 4 and as per block 40 in FIG. 2, the sacrificial polymer layer 22 is deposited on the substrate 18 over the thermal barrier layer 26. Next, as seen in FIG. 5 and as per block 42 in FIG. 2, the heater or resistive layer 28 comprised of a first metal is deposited on the sacrificial polymer layer 22. Then, as seen in FIG. 6 and as per block 44 in FIG. 2, the conductor layer 30, comprised by a second metal typically selected from a wide variety of conductive metals is deposited on the first metal resistive layer 28 to complete the deposition of the layers of the first strata 12. Following next, as seen in FIG. 7 and as per block 46 in FIG. 2, once the resistive and conductor layers 28, 30 are deposited, they are patterned, masked and etched, in separate steps by conventional semiconductor processes, such as wet or dry etch techniques. In such manner, the etched first resistive metal layer 28 provides the fluid heater element 16 of the heater stack 10 and the etched second conductor metal layer 30 provides the power and ground leads for the resistive heater element 16. The resistive and conductor layers 28, 30 may be selected from materials and may have thicknesses such as set forth in above cited U.S. Pat. No. 7,195,343.

Figure 8:
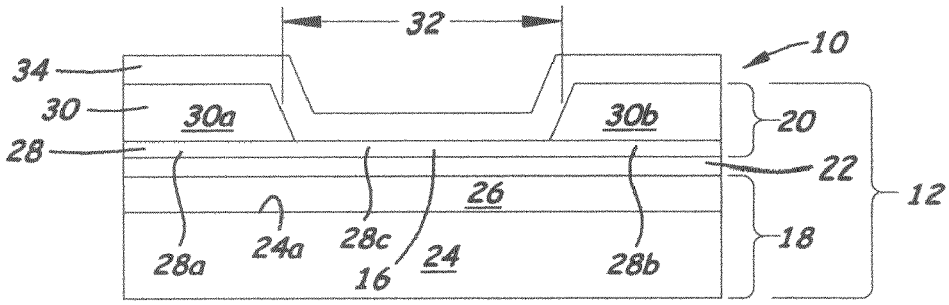
Figure 9:
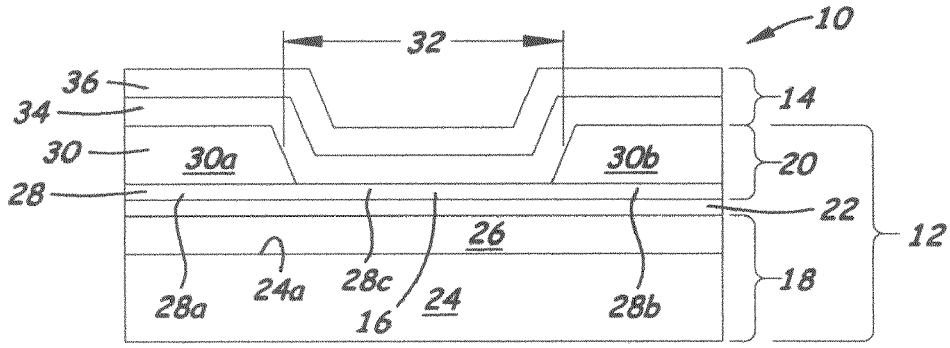

Turning next to FIGS. 8 and 9, there is illustrated the sequence of stages in building the layers making up the second strata 14 of the heater stack 10. As seen in FIG. 8 and as per block 48 in FIG. 2, the passivation layer 34 of the second strata 14 is deposited over and directly on the resistive and conductor layers 28, 30 of the heater substrata 20 in order to provide electrical insulation. The cavitation layer 36 is then deposited on the passivation layer 34 overlying the heater substrata 20. The passivation layer 34 and cavitation layer 36, also referred to as the heater overcoat in U.S. Pat. No. 7,195,343, may be selected from materials and may have thicknesses such as set forth in this patent. As seen in FIG. 9 and as per block 50 in FIG. 2, once the passivation and 15 cavitation layers 34, 36 are deposited, they are patterned, masked and etched, in separate steps by conventional semiconductor processes, such as wet or dry etch techniques.

Figure 10:
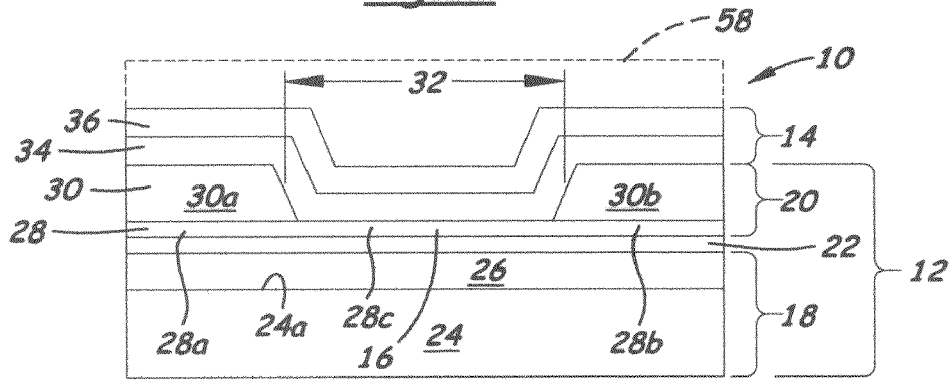
Figure 11:
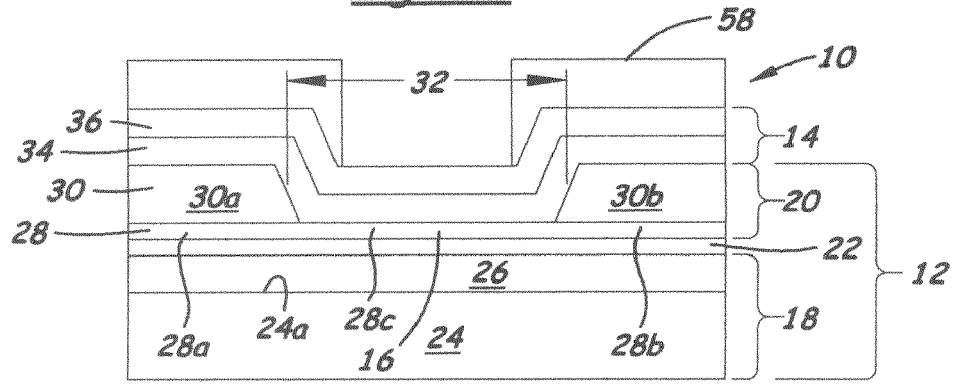

Finally, turning to FIGS. 10 and 11, there are illustrated the step in processing the sacrificial polymer layer 22 of the first strata 12 of the heater stack 10 and additional steps to seal the void or gap between the heater element 16 and the substrate 18. As seen in FIG. 10 and as per block 52 in FIG. 2, after completion of the steps in building the layers making up the second strata 14 of the heater stack 10, processing of the sacrificial polymer layer 22 takes place. The processing step is the decomposition of the polymer layer 22 through an annealing process with or without oxygen. This process degrades the polymer into carbon or just simply turns the polymer into ash with a minimal of residue remaining. As seen in FIGS. 10 and 11 and as per blocks 54 and 56 in FIG. 2, after completion of the decomposition of the polymer of the sacrificial layer 22, a layer 58 of dielectric material is deposited, as shown in FIG. 10, and patterned, as shown in FIG. 11, on the second strata 14 to seal the gap or void between the heater or resistive layer 28 and the substrate 18.

Turing now to FIG. 12, there is illustrated a second exemplary embodiment of the heater stack 10 of the micro-fluid ejection device in accordance with the present invention. The second embodiment of the heater stack 10 is similar to the first embodiment in that the first strata 12 of both are substantially identical in structure and in their method of formation. Thus, the discussion of FIGS. 2-7 hereinbefore in reference to the first exemplary embodiment of FIG. 1 applies equally to the second exemplary embodiment of FIG. 12 and so need not be repeated. Furthermore, in the second exemplary embodiment, the second strata 14 of the first embodiment has been omitted as have the corresponding sequence of stages of FIGS. 8 and 9 and the steps represented by blocks 48 and 50 in FIG. 7.

Turning finally to FIGS. 13-15, there is illustrated, in FIG. 13, a block flow diagram of a sequence of the steps in making the second exemplary embodiment of the heater stack of FIG. 12 and, in FIGS. 14 and 15, schematic representations of the stages that are used with those of FIGS. 3-7 and 10 in making the second exemplary embodiment of the heater stack of FIG. 12 in accordance with the flow diagram of FIG. 13. After completion of the decomposition of the sacrificial polymer layer 22 through the same process as discussed previously, as now seen in FIGS. 14 and 15 and as per blocks 60 and 62 in FIG. 13 a layer 64 of dielectric material is deposited on the heater substrata 20.

A principle underlying the design of some embodiments of the heater stack 10 of the present invention is that the resistive film or layer 28 is delaminated from the substrate 18, and particularly from the thermal barrier layer 26 on the base layer 24 of the substrate 18. The sacrificial layer 22 is made up of a suitable preselected polymer that is processed by being decomposed so as to provide a delaminated or decoupled relationship, thus providing a void, at least between the fluid heater element 16 and the substrate 18. For a polymer to be suitable for use as the sacrificial delamination layer 22, it should be compatible to current CMOS processing conditions i.e. its decomposition temperature should be below 400° C. However, it should also maintain its structural integrity during the heater deposition step at approximately 150° C. Under the current thermal processing conditions, polymers that may be used include polymethylmethacrylate (PMMA), polybutylene terephthalate (PBT), and polycarbonate. Different thermal processing conditions may lead to different polymer choices.

As a result of the presence of the decoupled relationship, during the heat-up period of a respective one of the cycles of fluid ejection the fluid heater element 16 buckles away from and out of physical contact with the substrate 18. This buckling is due to thermal expansion of the overlayers 68 and the material of the fluid heater element 16 in response to the electrical activation thereof. This, in turn, enables the fluid heater element 16 to transfer heat energy for producing fluid ejection into the fluid, without transferring as much heat energy into the substrate 18 as occurs in other ejector devices. The buckled condition of the fluid heater element 16 is depicted in FIG. 16A with respect to the second exemplary embodiment of the heater stack 10. Further, as a result of the presence of the decoupled relationship, during the next following cool-down period of the respective one of the cycles of fluid ejection the fluid heater element 16 de-buckles back toward and into physical contact with the substrate 18 due to compressive stress of overlayers 68 imposed on the fluid heater element 16 and the thermal contraction of fluid heater element 16 in response to the electrical deactivation thereof enabling the fluid heater element 16 to transfer residual heat energy to the substrate 18 and prepare for the following heat-up period of the next respective one of the cycles of fluid ejection. The de-buckled condition of the fluid heater element 16 is depicted in FIG. 16B.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A heater stack for a micro-fluid ejection device comprising:

first strata configured to support and form a fluid heater element responsive to repetitive electrical activation and deactivation to produce repetitive cycles of fluid ejection from said device; and second strata overlying said first strata to provide protection of said fluid heater element from adverse effects of said repetitive cycles of fluid ejection, each cycle involving alternating periods of heat-up and cool-down of said fluid heater element;

wherein said first strata includes a substrate a heater substrata overlying said substrate, and a sacrificial layer of material deposed between said substrate and said heater substrata and processed so as to provide a decoupled relationship at least between said fluid heater element and said substrate which, during the heat-up period of a respective one of said cycles of fluid ejection, results in said fluid heater element buckling away from and out of physical contact with said substrate due to thermal expansion of said fluid heater element in response to the electrical activation thereof enabling said fluid heater element to transfer heat energy for producing fluid ejection into the fluid substantially without transferring the heat energy into said substrate whereas said decoupled relationship, during the next following cool-down period of the respective one of said cycles of fluid ejection, results in said fluid heater element de-buckling back toward and into physical contact with said substrate due to thermal contraction of said fluid heater element in response to the electrical deactivation thereof enabling said fluid heater element to transfer residual heat energy to said substrate and prepare for the following heat-up period of the next respective one of said cycles of fluid ejection.

2. The heater stack of claim 1 wherein said sacrificial layer is on an insulating layer of said substrate.

3. The heater stack of claim 1 wherein said sacrificial layer is a polymer.

4. The heater stack of claim 1 wherein said polymer is one of polymethylmethacrylate and polybutylene terephthalate.

5. The heater stack of claim 3 wherein said decoupled relationship creates a void that substantially isolates said fluid heater element from said substrate.

6. The heater stack of claim 1 wherein said heater substrata includes:

a resistive layer overlying said substrate and a conductor layer having an anode portion and a cathode portion separated from one another by a gap and overlying and deposited on lateral portions of said resistive layer being interconnected and separated by a central portion of said resistive layer deposed under said gap of said conductor layer so as to define said fluid heater element.

7. The heater stack of claim 6 wherein said second strata includes:

a passivation layer overlying said anode and cathode portions of said conductor layer and also overlying said central portion of said resistive layer defining said fluid heater element of said heater substrata.

8. The heater stack of claim 7 wherein said passivation layer is a dielectric layer having a portion on said fluid heater element being of a thickness substantially less than the thickness of the portions of said dielectric layer on the remainder of said heater substrata.

9. The heater stack of claim 8 wherein said portion of said dielectric layer on said fluid heater element is formed by oxidation of a deposited precursor metal.

10. A method for making a heater stack for a micro-fluid ejection device, comprising:

processing one sequence of materials to produce first strata supporting and forming a fluid heater element, wherein said processing the one sequence of materials includes depositing a sacrificial layer of a predetermined material on a substrate, and depositing and patterning layers of resistive ant conductive materials on the sacrificial layer to produce heater substrata supporting and forming thereon the fluid heater element responsive to repetitive electrical activation and deactivation to produce repetitive cycles of fluid ejection from said device, each cycle involving alternating periods of heat-up and cool-down of the fluid heater element corresponding respectively to the repetitive electrical activation and deactivation of the fluid heater element, and decomposing the sacrificial layer of the predetermined material so as to produce a coupled relationship between at least the fluid heater element and the substrate which, during the heat-up period of a respective one of said cycles of fluid ejection, results in the fluid heater element buckling away from and out of physical contact with the substrate due to thermal expansion of the fluid heater element in response to the electrical activation thereof enabling the fluid heater element to transfer heat energy for producing fluid ejection into the fluid substantially without transferring the heat energy into the substrate whereas the decoupled relationship, during the next following cool-down period of the respective one of the repetitive cycles of fluid ejection, results in the fluid heater element de-buckling back toward and into physical contact with the substrate due to thermal contraction of the fluid heater element in response to the electrical deactivation thereof enabling the fluid heater element to transfer residual heat energy to the substrate and prepare for the following heat-up period of the next respective one of the cycles of fluid ejection; and processing another sequence of materials to produce second strata overlying the heater substrata and the fluid heater element thereof to provide protection of the fluid heater element from adverse effects of the repetitive cycles of fluid ejection.

11. The method of claim 10 wherein said decomposing the sacrificial layer occurs with oxygen.

12. The method of claim 10 wherein said decomposing the sacrificial layer occurs without oxygen.

13. The method of claim 10 wherein said decomposing the sacrificial layer includes delaminating the restrictive layer from the substrate.

14. The method of claim 10 wherein said decomposing the sacrificial layer includes producing a void between the resistive layer and the substrate.

15. The method of claim 10 wherein said depositing the sacrificial layer comprises depositing a layer of a preselected polymer on the substrate.

16. The method of claim 15 wherein said depositing the sacrificial layer comprises depositing a layer of one of polymethylmethacrylate and polybutylene terephthalate.

17. The method of claim 15 wherein said decomposing comprises thermally degrading the preselected polymer.

18. The method of claim 10 wherein said processing the another sequence of materials includes:

depositing and patterning a precursor material on the heater substrata so as to provide a portion of the precursor material layer on the fluid heater element; and passivating the fluid heater element by oxidizing the portion of the precursor material layer thereon.

19. A heater stack for a micro-fluid ejection device, comprising:

first strata configured to support and form a fluid heater element responsive to repetitive electrical activation and deactivation to produce repetitive cycles of fluid ejection from said device; and second strata overlying said first strata to provide protection of said fluid heater element from adverse effects of said repetitive cycles of fluid ejection, each cycle involving alternating periods of heat-up and cool-down of said fluid heater element;

wherein said first strata includes a substrate, a heater substrata overlying said substrate, and a sacrificial layer of material deposed between said substrate and said heater substrata and processed so as to provide a decoupled relationship at least between said fluid heater element and said substrate, such that said fluid heater element moves away from and out of physical contact with said substrate in response to the electrical activation thereof, and said fluid heater element moves back into physical contact with said substrate during a following cool-down period of the one of said cycles.

* * * * *